United States Patent [19]

Faulstich et al.

[11] 4,004,310

[45] Jan. 25, 1977

[54] MARKER BUOY RECOVERY AID

[75] Inventors: Albert J. Faulstich, Laurel; James B. Johnson, Silver Spring; Gerhard B. Winkler, Rockville, all of Md.

[73] Assignee: The United States of America as represented by the Secretary of the Navy, Washington, D.C.

[22] Filed: Mar. 1, 1976

[21] Appl. No.: 662,646

[52] U.S. Cl. ..... 9/9

[51] Int. Cl.[2] ..... B63C 7/26

[58] Field of Search ..... 9/8 R, 9; 114/16.5

[56] References Cited

UNITED STATES PATENTS

| | | | |
|---|---|---|---|
| 3,374,494 | 3/1968 | Hunley | 9/9 X |
| 3,407,418 | 10/1968 | May et al. | 9/9 |
| 3,419,927 | 1/1969 | Stoffer et al. | 9/9 |

*Primary Examiner*—Trygve M. Blix
*Assistant Examiner*—Gregory W. O'Connor
*Attorney, Agent, or Firm*—R. S. Sciascia; A. L. Branning

[57] ABSTRACT

A marker buoy, attachable to a submersible article by controllable explosive cutter, is provided with a buoyant housing having an interior chamber for storage of a coiled length of flexible cord connecting the buoy to the submersible article. The chamber is provided with vents to permit water flow therethrough. An element of buoyant material within the chamber helps to orient the top surface of the buoy in the upward direction. Release of the buoy by the explosive cutter permits it to float to the surface, with the flow of water through the chamber vents ensuring rapid ascent.

5 Claims, 2 Drawing Figures

MARKER BUOY RECOVERY AID

BACKGROUND OF THE INVENTION

1. Field of the Invention

This invention relates to apparatus and equipment for use in marking the water surface location where an object of interest has sunk to enable a rapid recovery operation. The marker buoy of this invention is particularly applicable to rapid location of submerged surface vessels, aerially dropped devices, or re-entry vehicles. When an object of values has sunk, either by accident or otherwise, the location may be of substantial importance. In the instance where personnel are in a sunken craft, the time required to locate the point where the craft has sunk would be of critical importance. In other situations, the marking of a spot or of an area could be of importance to indicate and mark the location where, due to the presence of an object that has sunk, a dangerous situation would be presented to marine traffic if not properly warned. The general use of the marker buoy described herein would permit rescue or salvage operations to be undertaken with a minimum loss of time, the time of recovery measured from the time of drop to the time of identifying drop location.

2. Description of the Prior Art

Devices to mark water surface areas and locations and or to identify where an object of interest has sunk are all well known and have been displayed over the years in numerous embodiments and configurations for each specialized need the device was developed. Illustrative examples of more recent devices used as aids in marking locations are disclosed in U.S. Pat. Nos. 3,553,751 to Lewis, 3,310,820 to Elo and 3,121,889 to Gentile. These devices, however, are difficult and expensive to manufacture, complex in operation, and yet not sufficiently rugged and durable for severe oceanic environments.

Other examples of devices previously used to help locate sunken objects for recovery include "pingers" and "bubblers." A "pinger" is an electrical signal sending unit which produces a "ping" at a specified interval and frequency to help in locating the object by measuring signal response differentials. The "bubbler" is a short duration phenomena device that allows the underwater release of air, thereby sending a column of air bubbles to the water surface. Both were inefficient and the time required to locate the object was too long and too costly for most recovery operations and would be unacceptable for operations requiring rapid location of craft containing personnel.

SUMMARY OF THE INVENTION

The disadvantages of location finding methods and devices described above and presented in the prior art have been overcome by the marker buoy of the present invention which basically includes a housing having a vented chamber wherein is located a hollow shaft, a coiled length of flexible cord attached to the housing at one end and to an object to be recovered at the other end, and severable holding means that firmly holds the marker buoy in position on the object until activation of a cutter that severs the hold on the buoy, thereby releasing the buoy to float to the water surface.

An important feature of the marker buoy of the present invention resides in the construction of the buoy housing to include at least a pair of openings to permit effective use of the difference between the buoy interior pressure and the hydrostatic pressure that acts on the buoyant float to provide a vent line for water flow. Once the severable holding means release the marker buoy, a disk of concentrated buoyant float material in the housing initially helps to orient the top surface of the buoy in an upward, water surface-seeking direction. Then upon attaining such orientation, external water is allowed to flow through the marker buoy from a top surface opening into the housing chamber and then out through a bottom surface opening, whereby water flows through the housing chamber as the buoy rises to the water surface.

Another feature of the improved buoy is the novel use of a shaft with a centrally disposed bore that provides effective venting of the water from the housing chamber. Neat and compact packaging of the object attachment hardware is provided by means of a shaft recess.

The shaft can also be utilized as an unwinding axis for the flexible cord if needed, rather than having the cord being simply coiled and placed in the chamber.

The cutter of the severable holding means is signal responsive and is activated only by signal. The cutter can be responsive to and be activated by signals that are essentially selfcontained, such as by a time delay circuit, energization of a hydrostatic pressure switch when the buoy sinks to a pre-selected depth, or by impact forces, as through a water entry. In the embodiment described herein, a simple direct current circuit is provided, and thus the recovery operation could be considered in a sense to be utilizing a buoy that is "automatic" in operation. The activation signal could also be external to the marker buoy and transmitted to the buoy by telemetry.

It is therefore a primary object of this invention to provide a marker buoy for severable attachment to a sunken article of interest that is inexpensive to manufacture, easy to attach, simple to operate, and lightweight in construction.

Another object is to provide a simple yet efficient device for marking locations on water surface or which can be used as a location signaling device in water related activities.

Another object of this invention is to provide a recovery location marker that is automatic in operation.

A further object is to provide a ventable buoy to more easily achieve and maintain water surface seeking orientation of the buoy.

These and other objects and advantages of the invention will become apparent upon reading the following description of the illustrative embodiment with reference to the attached drawings wherein like reference numerals have been used to refer to like or corresponding parts throughout the several figures, and wherein:

DESCRIPTION OF THE PREFERRED EMBODIMENT

Figure 1:
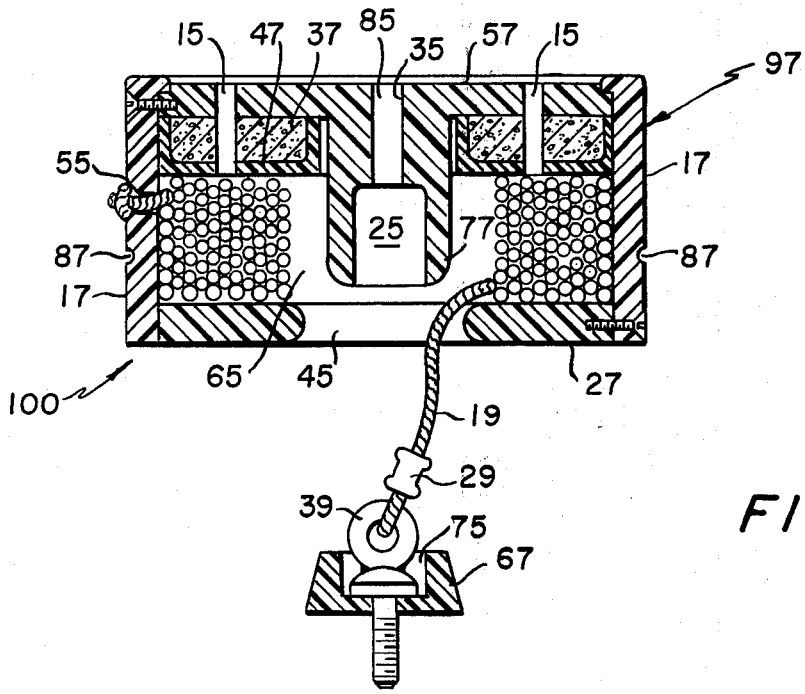
FIG. 1 is a horizontal, sectional view of the marker buoy of the present invention.

Referring now to the drawings, FIG. 1 shows a horizontal, sectioned view of the marker buoy, generally denoted as 100 comprising a housing 97 having an interior chamber 65 for a coiled flexible cord 19 and a shaft 77.

Figure 2:
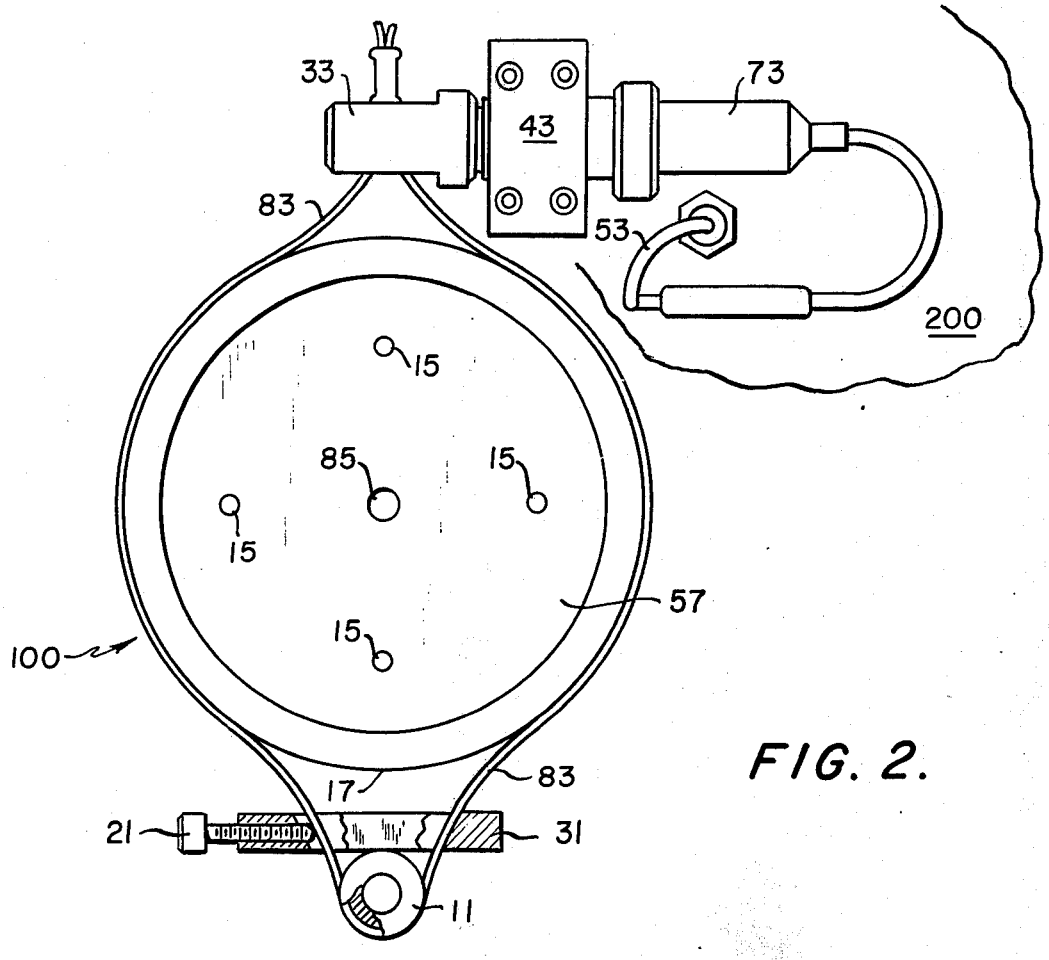
FIG. 2 is a plan view of the top of the marker buoy showing the severable holding means with buoy holder.

Housing 97 can be of any reasonably regular geometrical shape and is constructed of a buoyant material to aid in flotation. A cellular plastic material is preferable from the perspective that plastic is not only light in weight, but also is easy to work with, durable and rugged. The bottom 27 of the housing 97 has an opening 45 designed for closure by tapered stopper 67 provided with a recess 75. The exterior surface of side 17 is provided with a circumferential groove 87 which receives a wire rope 83 (FIG. 2). An interior lip extends around the upper circumferential edge of the side 17 for coaction with the top 57.

The central shaft 77 is formed as part of the top surface and projects with the interior chamber 65 and has cavity 25 which is aligned within the bottom opening 45 to receive the end of an eyebolt 39 attached to the tapered stopper 67. The eyebolt is used to attach the flexible cord to the article of interest. The shaft also has a central bore 35 that extends to the top surface to serve as a vent by terminating in top surface opening 85.

The flexible cord 19 is coiled within the chamber 65, surrounding the shaft 77, and is unwound through the opening 45. One end of the cord is attached to the marker buoy housing, as in a knot at the hole 55 in the side 17, and the other end is attached by the eyebolt 39 to the article of interest. The cord is made of a suitable, lightweight and buoyant material to aid in the overall buoyancy of the marker buoy. Polypropylene rope is one suitable material for use as an attachment cord.

To further aid in orientation of the top surface of the buoy housing as positive upward, the inner top surface facing the interior chamber is provided with a disk of concentrated buoyant foam 37, encased within a reinforcing disk 47 and provided with a plurality of vent holes 15 which air the chamber vent action. Polyurethane is an example of one suitable material.

The severable holding means as shown in FIG. 2 associates the wire rope 83 with the housing 97 by passing the rope through a clamp 33 to mate with and over exterior housing groove 87, through a tensioning apparatus and back over the housing and back through the clamp into holding engagement. To reduce the tensile stresses that would be created in the wire rope due to tensioning, the tensioning apparatus used in one embodiment comprised a grooved circular hoop and a slotted bar. The circular hoop 11 increases the bend radius the wire would conform to and is provided with a slot to receive and retain wire within. The hoop is held in pressing engagement with a slotted tensioning plate 31 by means of an adjustable tensioning bolt 21 advancingly pressed against the rope within the plate.

To separate the buoy housing 97 from the submerged article, an explosive cutter 73 is activated by a signal from a signal package within the submerged article transmitted by cable 53 from the sunken article 200 through an explosive fitting 43 to sever the wire rope held in the clamp. Activation signals could be automatic in that triggering of the cutter could be done by pressure, whereby a pressure switch could be present to close and activate the cutter where a predetermined depth is reached, by time delay, or by hydrodynamic impulse forces imparted to the article from impact with the water upon entry. Other transmittable telemetry signals to activate a simple electronic circuit can be selected.

In one embodiment of the marker buoy the cellular plastic housing is constructed of polypropylene. A fixture initially positions the top and the bottom surfaces of the housing and the flexible cord is coiled about inwardly in the buoy chamber. When the chamber is filled by the cord the side surface is slipped over the cord and secured to the top and bottom surfaces with screws. The reinforcing disk is made of the same or of a similar cellular plastic material and is secured to the side surface with nylon screws. A polyurethane foam is one suitable buoyant material for the top disk. One end of the flexible cord is fastened to the side surface opening in the form of a knot. The other end is passed through the "eye" of the eyebolt and through the sleeve of a nicopress fitting 29 to compressively hold the two cord surfaces together. The tapered stopper is then inserted over the eyebolt screw section and the combination is then securely attached to the article of interest. The buoy housing is slipped over and onto the stopper in a detachably held friction engagement. The wire rope cutter with cutter housing, clamp and explosive fitting is then detachably assembled in holding arrangement with the wire rope by slipping the wire through the cutter clamp, wrapping it around and in the groove of the buoy housing, through the slot in the tensioning plate, over and around the hoop, back through the slot in the plate, over the housing, and back to the cutter clamp and secured there with the nicopress sleeve. By advancing the tensioning bolt in the tensioning plate, all slack is removed from the rope. Advancement of the bolt produces what ever holding tension is desired in the wire rope. The instrumentation cable from the signal package is then connected to the explosive cutter. The marker buoy is then ready for use in aquatic applications to provide a releasable water surface location indicator to be used in conjunction with locating or recovering articles of interest that have sunk.

Illustrative of the intended mode of use would be a situation whereby a re-entry craft with an attached marker buoy would sink either in an unknown area or at an unknown time. Either upon transmission of a signal externally to the signal package of the recovery aid or upon generation of self contained signal means, such as by depth or as by a timing device, the cutter means would be activated, forcing the cutter blade to sever the wire containment rope encircling the buoy housing. Wire rope severance would leave the marker buoy free to float. Having so inserted the tapered stopper into the bottom opening of the buoy housing with a weak force friction fit, the positive buoyancy of the float is sufficient to overcome the friction force and to thereby release the buoy to float to the surface. The tapered stopper release provides an opening through the bottom surface which permits the flexible cord to play out as the buoy ascends towards the water surface and also provides buoy venting between the top and bottom surface openings of the buoy through the shaft. As the cord plays out, the mass center of the cord is always such that the buoyant mass of the flexible cord and the disk of concentrated foam forces the marker buoy to be oriented positive upward. The only limitation on the use of this recovery aid as to locating sunken articles is the amount of flexible cord the buoy housing can carry, which in turn determines the depth to which an article may sink and still be found by surface location indication.

Obviously, numerous modifications and variations of the present invention are possible in the light of the above teachings. For example, the marker buoy could be air launched or mounted on the side of an air borne re-entry craft, used on submergible craft such as submarines, test operations involving torpedoes and other naval ordnance, deep sea diving research or any application where a surface area or spot should be clearly marked to provide clear identification, as when dangerous chemicals exist locally or when dangerous conditions prevail locally that others should be alerted to. It is therefore to be understood that within the scope of the appended claims the invention may be practiced otherwise than as specifically described herein.

We claim:

1. A marker buoy attachable to a submerisible article comprising, in combination:

a buoyant housing having an interior chamber and an annular groove on the external surface;

a concentrated, buoyant material attached to the top surface of said chamber to provide initial upright orientation of the upper portion of said housing when afloat;

a length of flexible cord coiled within and extending from said chamber for connecting said housing to a submersible article;

venting means including an opening in each of the upper and lower surfaces of said housing to permit water flow through said interior chamber; and controllable attachment means for detachably securing said housing to a submersible article, whereupon release of said housing from the submersible article, said buoyant housing and said concentrated buoyant material effect and upright orientation of said housing and a positive buoyancy, and the difference between the hydrostatic and the chamber pressures vents water through said venting means as the buoy rises to the water surface.

2. A marker as recited in claim 1 wherein said venting means comprises:

a tubular element projecting into said interior chamber from the top surface of said housing; and a centrally disposed bore within said element to provide fluid communication between said interior chamber and the exterior of said housing.

3. A marker buoy as recited in claim 2 further comprising:

a recess provided at the interior end of said tubular element;

a tapered element for closing the opening in the lower surface of said housing, said element having an inner, recess cavity aligned with said tubular element recess; and coupling means positioned within said recess for joining said flexible cord to the submersible article.

4. A marker buoy as recited in claim 3 wherein said controllable attachment means include:

means to severably joint the buoyant housing to the submersible article; and signal responsive means to control activation of said severable means.

5. A marker buoy as recited in claim 4 wherein said severable joining means comprises:

a wire rope for fitment within said buoy housing annular groove;

means for adjusting the tension on said rope;

a clamping device attachable to the end of said rope; and a cutter mechanism coupled to said clamping device and said signal responsive means, whereby the buoy is coupled to the submersible article until release by activation of the cutter by the signal responsive means, with the buoy and submersible article remaining interconnected by said flexible cord.

* * * * *